United States Patent [19]

Lynn et al.

[11] 4,234,389

[45] Nov. 18, 1980

[54] COOLING NAPHTHALENE-BEARING WATERS AND GAS STREAMS

[75] Inventors: James B. Lynn, Bethlehem; Otto A. Homberg; Kenneth R. Burcaw, Jr., both of, Easton, all of Pa.

[73] Assignee: Bethlehem Steel Corporation, Bethlehem, Pa.

[21] Appl. No.: 13,583

[22] Filed: Feb. 21, 1979

[51] Int. Cl.[2] ..... C07C 15/14; C07C 7/00

[52] U.S. Cl. ..... 201/30; 55/89; 585/804; 585/833

[58] Field of Search ..... 55/89, 84, 85; 201/29, 201/30; 202/260, 227, 254, 255, 265; 585/804, 812, 833, 834, 867

[56] References Cited

U.S. PATENT DOCUMENTS

| | | | |
|---|---|---|---|
| 2,067,029 | 1/1937 | Van Ackeren | 48/203 |
| 2,699,225 | 1/1955 | Dahlbeck | 55/89 |
| 2,877,866 | 3/1959 | Mathis et al. | 55/89 |
| 2,953,514 | 9/1960 | Wilkins | 208/95 |
| 3,458,588 | 7/1969 | Meyer et al. | 201/29 |
| 3,471,999 | 10/1969 | Schon | 55/85 |
| 3,793,389 | 2/1974 | Oleszko et al. | 585/834 |
| 4,150,958 | 4/1979 | Jablin | 55/89 |
| 4,154,584 | 5/1979 | Ullrich | 201/29 |

*Primary Examiner*—Norman Yudkoff

*Attorney, Agent, or Firm*—Joseph J. O'Keefe; Charles A. Wilkinson; Michael Leach

[57] ABSTRACT

A method for cooling naphthalene containing gas streams using recirculated cooling water comprising physically separating suspended naphthalenic solids from the used cooling water, injecting a water immiscible solvent for naphthalene into the clarified cooling water, and vigorously mixing the solvent and cooling water to form a dispersion which is recooled in an indirect heat exchanger without serious buildup of naphthalenic solids in the heat exchanger and recycled to cool the gas stream.

20 Claims, 2 Drawing Figures

COOLING NAPHTHALENE-BEARING WATERS AND GAS STREAMS

FIELD OF THE INVENTION

This invention relates to a method for cooling naphthalene-containing gas and liquid streams and, more particularly, to a method for removing naphthalene in the final cooling of coke oven gas with recirculating water without serious buildup of naphthalenic solids in heat exchanger or other apparatus through which the cooling water passes.

BACKGROUND OF THE INVENTION

In the process of coking coal in the absence of air, large volumes of gas, commonly called coke oven gas, are produced in addition to the carbonaceous residue. This coke oven gas contains valuable by-products such as ammonia, naphthalene, tar and light oils comprising benzene, toluene and other hydrocarbons which are typically recovered in by-product recovery systems associated with the coke oven plants.

In the by-product recovery processes currently in use, the hot coke oven gas leaves the coking furnaces at temperatures of 600° -700° C. and is shock cooled by a spray of aqueous flushing liquor in a collecting main. This cooling effects a condensation of some of the vapors and removes heavy tar from the coke oven gas. The non-condensed gases at about 75° -80° C. are directed to a primary cooler where further cooling to about 35° -50° C. by spraying with water or ammonia liquor removes additional tar. Part of the ammonia present in the gas is absorbed in the aqueous liquor and, together with the tars and a large portion of naphthalene that are condensed, is carried away with the so-called "ammonia liquor". Any tar remaining in the gas is usually removed in a subsequent electrostatic precipitator.

At this point in the process following the primary coolers and electrostatic precipitators, the gas is contacted with sulfuric acid to remove any remaining ammonia preparatory to its treatment for the recovery of light oils and subsequent scrubbing to eliminate hydrogen sulfide. Although the gas from the ammonia absorber has most of its naphthalene content removed with the tars during the initial cooling of the gas, a significant amount of naphthalene vapor remains in the coke oven gas at this point. Further cooling of the gas is achieved in a final cooler to lower the temperature of the gas stream for efficient processing in the light oil by-product recovery stage.

Cooling of the coke oven gas in the final coolers from about 35° -50° C. to about 20° C. results in the naphthalene vapors precipitating as crystallized solids and is usually accomplished by direct contact of the gas with a cooling liquid. The gas may be passed through a spray of the cooling liquid or it may be bubbled through the liquid. The cooling liquid may be a solvent for naphthalenic materials such as washing oils or benzol oils from the light oil recovery plant. Therefore, in addition to cooling the gas, the precipitated naphthalenic solids are immediately dissolved in these cooling liquids. The liquid effluent from the final cooler must then be stripped of the dissolved solids in additional apparatus to permit recycling of the cooling liquid. Alternatively, the final cooling may be a cold water quench with the precipitated naphthalenic solids being removed from the final cooler as a slurry with the used final cooler water. The solids should be removed prior to recycling the cooling water.

In addition to the naphthalenic solids, a quantity of water vapor also condenses from the coke oven gas and is contaminated with dissolved ammonia, cyanides, sulfides and phenols in dilute concentrations. Accordingly, direct discharge of the once-through cooler water after separation of the naphthalenic solids is not feasible. Furthermore, disposal after removal of the toxic contaminants from the once-through cooling water in a waste water treatment facility is impractical because of the large volume of effluent to be treated. However, recycling of the cooling water results in an accumulation of the contaminants to a concentration that makes treatment of a bleed-stream of the recycling cooling water acceptable.

Because the cooling water that is to be recycled has absorbed heat values from the gas stream and from the condensation of naphthalenic solids and water, it necessarily must be cooled in a heat exchanger after physical separation of suspended naphthalenic solids and prior to reuse in the final cooler. A direct heat exchanger is eliminated as a possibility because toxic contaminants from the water of condensation would be volatilized into the atmosphere. Accordingly, an indirect heat exchanger is the remaining choice.

Nevertheless, such a final cooler system having a recirculating water loop incorporating a solids separator and an indirect heat exchanger does not afford smooth, trouble-free operation. Because the physical separation means cannot completely remove the precipitated naphthalenic solids, there is always some solids suspended in the "clarified" cooling water. Furthermore, the cooling water is saturated with dissolved naphthalenic solids which crystallize out in the indirect heat exchanger as the recycled water is cooled. These suspended and crystallized solids may adhere to the surfaces of the indirect heat exchanger or other equipment possessing flow constrictures clogging the apparatus.

Attempts have been made to solve this problem by recovering the suspended and dissolved naphthalenic solids from the cooling water with bulk quantities of solvent. In U.S. Pat. No. 3,471,999 issued to Sch,uml/o/n the cooling water is countercurrently extracted with a solvent for naphthalene. Using large quantities of solvents in a water final cooling system dictates additional equipment and expense to separate the ladened solvent from the water and to strip the solvent from the recoverable naphthalene for reuse.

Therefore, there is a need for a practicable method for the final cooling of coke oven gas using recycled water as the cooling medium.

There is also a need for a method of cooling naphthalene-bearing water with an indirect heat exchanger without clogging.

There is still a need to economically treat naphthalene-bearing water with a solvent to prevent blockage of water conduits in an indirect heat exchanger.

SUMMARY OF THE INVENTION

The above-mentioned difficulties with cooling naphthalene-bearing waters in an indirect heat exchanger and with a recirculating water final cooling system for a naphthalene containing gas have been solved with this invention. We define a naphthalene-bearing or naphthalene-containing water stream to be a water stream that contains dissolved naphthalenic solids or dissolved and suspended naphthalenic solids. A naphthalene-containing gas stream contains naphthalene vapors.

We have discovered a method for cooling a naphthalene-bearing water stream containing less than about 225 ppm suspended naphthalenic solids without serious buildup or clogging of the cooling apparatus with naphthalenic solids which comprises injecting into the water stream an amount of a substantially water immiscible solvent for naphthalene that is effective to prevent blockage of a downstream indirect heat exchanger The solvent and water stream are mixed to afford a dispersion of the solvent in the water stream which is subsequently cooled in the indirect heat exchanger.

We have also discovered a method for the cooling of a napthalene containing gas, such as coke oven gas, comprising (a) cooling the gas by contacting it with water, (b) collecting the used cooling water containing dissolved and suspended naphthalenic solids, (c) physically separating the solids from the water to afford a substantially clarified water, (d) injecting an amount of a substantially water immiscible solvent for naphthalene into the substantially clarified water from step (c) which amount is effective to prevent deposition of naphthalenic solids on the cooling surfaces of a downstream indirect heat exchanger, (e) mixing the solvent and substantially clarified water mixture to yield a dispersion, (f) cooling the substantially clarified water containing the dispersed solvent in an indirect heat exchanger, and (g) recycling the cooled water to step (a).

BRIEF DEESCRIPTION OF THE DRAWINGS

DETAILED DESCRIPTION OF THE PREFERRED EMBODIMENTS

The present invention for cooling a naphthalene-bearing water stream or a naphthalene-containing gas stream will be explained using the final cooking of coke oven gas in a by-product recovery system as an illustration. In testing the feasibility of converting a final cooler for coke oven gas from one using washing oil to one using recirculated water, blockage problems developed in the indirect coolers for the return water. Analysis of the blockage problems indicated that crystallized naphthalenic solids were adhering to the cooling surface of the indirect heat exchanger. The build-up of material was mostly a regular crystalline formation rather than a merely random accumulation of condensed and suspended solids. This apparently indicates that the blockage solids are materials that had been dissolved in the saturated aqueous solution and crystallized on contacting the cooling surface, and are not solely solids that had been in suspension in the cooling water and collected on the cooling surfaces as the water coursed through the indirect cooler. With this understanding we discovered the method of the invention for preventing adherence of the solids that ordinarily lead to blockage of the indirect heat exchanger.

Figure 1:
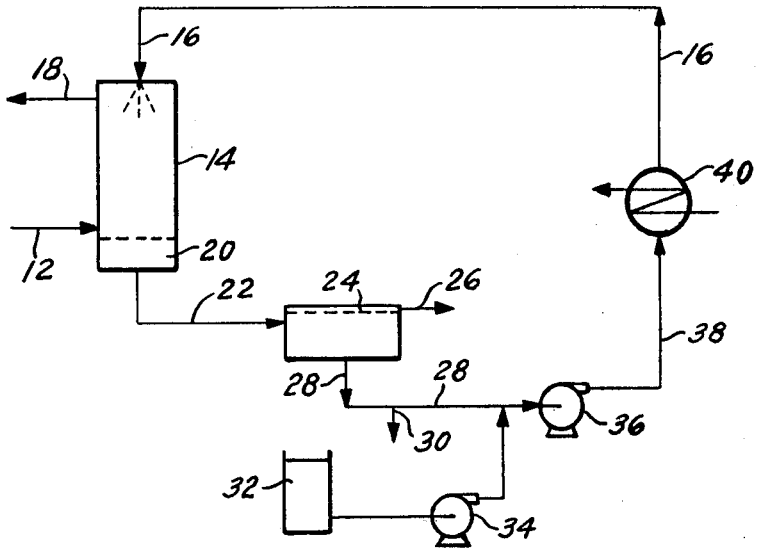
FIG. 1 is a schematic diagram of an arrangement of apparatus used in the practice of this invention.

In FIG. 1 coke oven gas at about 50° C. coming from the ammonia absorbers in a by-product recovery system is conveyed in gas line 12 into final gas cooler 14 where it is cooled by direct contact with sprayed water at about 20° C. from line 16. The coke oven as cooled to about 25° C. exists via gas line 18 for further processing for light oil recovery. Condensed naphthalenic solids collect as a slurry 20 in the cooling water in the bottom of final gas cooler 14. The cooling water also contains dissolved gases and condensable contaminants such as ammonia, cyanides, sulfides and phenols.

The slurry 20 exits the final cooler 14 in line 22 to a physical solids separation means 24 which can be a flotation cell, skimmer, centrifuge, filtration device or any appropriate device for removing the bulk of the naphthalenic solids which leave by line 26 for disposal. The clarified water in line 28 emanating from physical solids separation means 24 contains dissolved contaminants and some residual suspended solids the amount of which depends upon the efficiency of the solids separation means 24. Typically, the amount of suspended solids could range from 5 to 100 or more ppm of which roughly 90% is naphthalene. Obviously, the concentration of dissolved naphthalene will be at saturation levels with the actual amount depending upon the temperature of the water. This could be 30 ppm at 25° C. An amount of water equal to the volume of condensate produced in the cooling of the gas is removed from the system in bleed stream 30 for waste water disposal treatment.

A substantially water immiscible solvent for naphthalene obtained from solvent tank 32 is injected at a controlled rate by metering pump 34 into water line 28. The combined stream is conveyed by pump 36 via line 38 through indirect heat exchange 40 for cooling and subsequent recycling via conduit 16 to final cooler 14.

Figure 2:
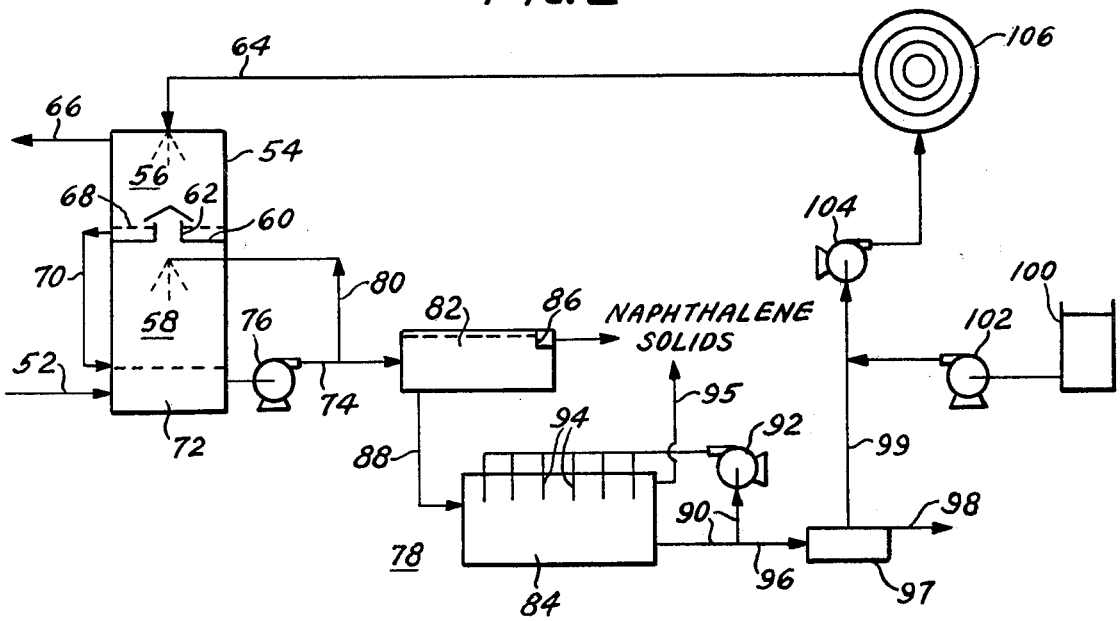
FIG. 2 is a preferred embodiment of the arrangement depicted in FIG. 1.

A preferred embodiment of a final cooling system for coke oven gas using recirculating water is shown in FIG. 2. The naphthalene containing coke oven gas 52 enters final cooler 54 which is segregated into two gas-liquid contacting zones 56 and 58 by partition 60 having a chimney 62 that permits the upward flow of gas through final cooler 54. Cooling water from conduit 64 is sprayed into contacting zone 56 where it contacts and cools coke oven gas that has passed through contacting zone 58 and chimney 62. The cooled gas exits via line 66. The slurry 68 of suspended naphthalenic solids an cooling water is collected on partition 60 and is transferred by line 70 into the bottom of contacting zone 58. The thick slurry 72 exits contacting zone 58 of final cooler 54 in line 74. Pump 76 conveys a portion of the slurry into physical solids separation means 78. The remainder of the slurry from line 74 is recycled via line 80 and pump 76 into contacting zone 58 in which the slurry is sprayed to initially cool the incoming coke oven gas and condense the major amount of naphthalene vapors.

In this embodiment the physical solids separation means 78 comprises tank 82 and air flotation cell 84. One function of the tank 82 is to accommodate fluctuations in the flow of the slurry from the final cooler 54. Additionally, it serves as a gravity separator in that the naphthalenic solids floating on the surface of the cooling water in the tank can be skimmed over weir 86 for collection and disposal. The crudely clarified cooling water is sent to air flotation cell 84 by piping 88. Substantially clarified liquid is taken by line 90 from flotation cell 84 and is forced by pump 92 through aspirators 94 back into the cell to generate an air bubble froth that carries the suspended solids to the surface where it is skimmed for disposal through line 95. Customarily, flocculating agents are added to the water in air flotation cell 84 to facilitate the removal of the suspended solids.

The clarified water in line 90 from air flotation cell 84 is saturated with dissolved naphthalene and contains small amounts of suspended solids. A quantity of the water in line 90 is passed by line 96 into sump tank 97. A portion of clarified water equivalent to the amount of water vapor from the gas stream that condenses in the final cooler 54 is bled or allowed to overflow from sump tank 97 by line 98 for further waste water disposal treatment.

A substantially water immiscible solvent for naphthalene, in this case secondary light oil from the subsequent light oil recovery plant, contained in tank 100 is metered by pump 102 into line 99 containing the clarified cooling water from sump tank 97. The mixture of solvent and clarified water is forced by pump 104 into and through spiral indirect heat exchanger 106 with the recooled water recycled by line 64 into contacting zone 56 of final cooler 54.

In the practice of the invention the solvent for naphthalene is injected into the cooling water at a rate effective to prevent any naphthalenic solids from adhering to the cooling surfaces of the downstream indirect heat exchanger. This means that the cooling surfaces are kept free of any material that may crystallize out of solution onto it as well as suspended solids that may accumulate. The injection rate necessary to accomplish this result is much less than that required for the extraction of the suspended and crystallized naphthalenic solids into the solvent phase. As shown in Table I the quantity of suspended solids in the warm, used cooling water stream is not appreciably changed after the solvent injection; and yet there was no evidence of blockage due to solids build-up on the cooling coils of the indirect heat exchanger.

TABLE I

| | No Solvent | Solvent Added |
|---|---|---|
| Solvent Injection Rate gal/1000 gal Water | 0 | 0.18 |
| Suspended Solids Before Injection ppm (mean) | 21 ± 13 | 38 ± 20 |
| Suspended Solids After Injection ppm | — | 37 ± 17 |
| Suspended Solids After Cooling ppm | — | *43 ± 23 |
| Status or Pressure and Flow | p→maximum Flow→0 4–5 days | Flow and pressure constant after 13 days |

*solids increase due to cooling of saturated solution

With respect to a given flow of naphthalene-bearing water, the effective solvent injection rate for avoiding blockages in the indirect heat exchanger may depend upon several factors such as the dissolved and the suspended naphthalenic solids content of the water stream, the flow velocity of the water stream through the heat exchanger, the temperature drop across the heat exchanger and possibly the design of the heat exchanger itself. In practice, an effective rate must be empirically determined for each particular system. However, an effective injection rate can range up to about 0.4 gal of solvent per 1000 gal of water which contains less than about 225 ppm of suspended naphthalenic solids. While such injection rates are satisfactory or workable for such naphthalene-bearing water, it is preferred for a practicable system that the injection rate range from about 0.015 to about 0.2 gal of solvent per 1000 gal of water which has a corresponding range of suspended naphthalenic solids less than about 100 ppm, preferably less than about 50 ppm. It is most preferred that the water stream contain 25 ppm or less of suspended naphthalenic solids. In other words, for a solvent injection rate of from about 0.015 to 0.2 gal per 1000 gal of water to be most effective, the solids separation means for physically removing suspended naphthalenic solids from a water stream should produce a "clarified" water having a suspended solids content less than about 100 ppm, preferably less than about 50 ppm. This also holds true for a recirculating water cooling system for a naphthalene containing gas stream that incorporates a physical solids separation means and an indirect cooler. The above injection rate range of 0.015–0.2 gal solvent per 1000 gal water was quite effective in preventing a water stream that contained less than about 100 ppm of suspended solids and flowed at 2 to 3 ft/sec from clogging an indirect cooler which produced a temperature drop of about 5° to 15° C. Much above 100 ppm of suspended naphthalenic solids, as a steady state condition, the consumption of solvent would necessarily become economically impractical although still technologically practical, and with much above 225 ppm the process may become an extraction because of the volume of solvent that would have to be injected to prevent blockage. Under the above operating conditions of less than about 100 ppm suspended solids and without any solvent injection, the indirect heat exchanger will become blocked in about 4 to 9 days of operation. For a naphthalene-bearing water stream that contains no suspended naphthalenic solids, the upper limit of suspended solids is, of course, irrelevant.

Occasionally the suspended solids content of the water stream may be subjected to wild fluctuations due to upsets of the solids separation step. During these upset conditions the suspended solids may attain a concentration of several thousand ppm. In these instances the solvent injection rate should be increased temporarily above the usual workable rate of 0.4 gal per 1000 gal of water. Even at several times the 0.4 gal rate, the process is still not an extraction. The pressure drop across a partially blocked indirect heat exchanger resulting from a surge in the suspended solids content of the water stream can be readily reduced to normal by such a temporary increase in the solvent injection rate. The duration of the increased injection rate may have to be extended into that period of time when the suspended solids content of the water stream is again at the lower steady state amount so long as there exists some blockage.

While these injections rates pertain particularly when the naphthalene solvent being used is light oil, the injection rates are good approximations for other solvents for naphthalene. Since the solvent for naphthalene is substantially immiscible with water, the solvent must be injected in such manner as to achieve a dispersion of the solvent in the water, preferably by a very vigorous or even violent mixing of the two liquids. Otherwise the solvent, if less dense than water, will merely float on the water during its passage through the coils of the heat exchanger without preventing the accumulation of solids on the cooling surfaces below the water line. The turbulent flow necessary to afford and maintain a dispersion of the solvent in the water can be achieved by injecting the solvent upstream of a pump. The mixture of liquids is violently agitated in the pump and emanates as an emulsion-like fluid. It is also possible that the requisite turbulence to form a dispersion may be created by the passage of the solvent and water stream through the constrictures of the indirect cooler in some instances.

While we do not wish to be bound by a particular theory, we believe the dispersion as it passes through the heat exchanger effectively "wets" its cooling surfaces with solvent thus denying any point of attachment to any naphthalenic solids whether they crystallize from the saturated cooling water or are present as suspended solids. If any solids do begin to adhere to the cooling surface, it is believed that the solids dissolve in the solvent on the "wetted" surface and are swept away by the rushing water stream while more dispersed "wetting" solvent recoats the cooling surfaces.

This injection of solvent is not the equivalent of adding a surface active agent (surfactant) to the water. While addition of a surfactant to the water lowers its surface tension and makes the water a better wetting agent, the water remains a relatively poor solvent for the naphthalenic solids with which it is already saturated. A surfactant is not a solvent for naphthalene. Consequently, crystallization will still occur on a cooling surface, whereas wetting the cooling surface with a solvent for naphthalene prevents naphthalenic solids from adhering. This view was borne out in at least one instance by the fact the indirect heat exchanger became plugged by a build-up of naphthalenic solids in spite of the presence of surfactants in the cooling water. These surfactants had been inadvertently added to the cooling water by the use of industrial water which contained surfactants as the dilution of make-up water during testing. Thus, the addition of surface active agents to the water has been found incapable of preventing heat exchanger fouling by naphthalenic bearing water.

Any solvent meeting the following criteria can be used in the practice of this invention:

(1) substantial immiscibility with water
(2) viscosity and surface tension less than water
(3) vapor pressure high enough to permit it to vaporize in the final cooler upon spraying
(4) a solvent for naphthalene and other closely related coal derived chemicals that are substantially insoluble in water Examples include, but are not limited to, benzene, toluene, light oil, carbon disulfide and chloroform.

Immiscibility with water is critical, otherwise the resulting homogeneous water-solvent solution would merely have an increased dissolution capacity for naphthalene. With constant recirculation the water-solvent mixture would eventually become saturated and again contain suspended solids.

It may also be possible that a very small amount of the substantially water immiscible solvent for naphthalene would have to dissolve and saturate the water before the low solvent injection rates will produce a dispersion of the solvent in the water. In such instances this small, initial quantity of solvent must be provided. Where the cooling water is recirculating and once the water is initially saturated with the substantially water immiscible solvent for naphthalene, the low solvent injection rates will continue to produce the two phase dispersion. Additionally, where a naphthalene containing gas stream which is to be cooled with water also contains such a solvent as a gaseous component of the gas stream, the used cooling water may become substantially saturated with the solvent after intimately contacting the gas stream during the cooling process. Recirculating the cooling water would enhance the level of the solvent dissolved in the water. As an example, coke oven gas also contains light oils comprising benzene and toluene and contacting the coke oven gas with a spray of water in the final cooler will result in light oil being dissolved in the used cooling water, albeit only a very small amount dissolves due to its substantial immiscibility with water.

A viscosity and surface tension less than that of water means the solvent is a better "wetting" agent than water and will, therefore, preferentially wet the cooling surfaces. By having a vapor pressure sufficiently high so that it can vaporize in the gas-cooling water contacting zone, the volatilized solvent will be carried to the downstream light oil recovery plant with the coke oven as where it can be recovered thus preventing its accumulation in the recirculating water which would result in a bulk extraction process.

This method for preventing the blockage of indirect heat exchangers with naphthalene-bearing water is particularly applicable to the cooling of naphthalene containing gas streams, such as coke oven gas streams, utilizing a closed-loop recirculated water cooling system which incorporates a solids separation stage using physical means and indirect heat exchangers or coolers. The term "physical solids separation means" is meant to exclude the separation of the suspended naphthalenic solids from the water by bulk extraction with a solvent. This invention is not a method for removing naphthalene from naphthalene-bearing water by solvent extraction, although a minor portion of the naphthalene solids may be extracted in the course of dispersing the solvent into the water stream. Furthermore, since the low solvent injection rate makes this invention practicable, a recirculated cooling water system without a physical solids separation stage would quickly overload the system with naphthalenic solids, far surpassing the capacity of the solvent injection rate to maintain unrestricted flow.

While particular embodiments of the present invention have been shown and described, it is apparent that various changes and modifications may be made, and it is therefore intended in the following claims to cover all such modifications and changes as may fall within the true spirit and scope of this invention.

We claim:

1. A method for cooling a naphthalene-bearing water stream that avoids heat exchanger blockage comprising (a) providing a naphthalene-bearing water stream which contains less than about 225 ppm suspended naphthalenic solids,
(b) injecting an amount of a substantially water immiscible solvent for naphthalene into the naphthalene-bearing water stream which amount is effective to prevent blockage of a downstream indirect heat exchanger,
(c) mixing the solvent and water stream to afford a dispersion of the solvent in the water stream, and
(d) cooling the water stream containing the dispersed solvent in the indirect heat exchanger.

2. The method of claim 1 in which the solvent is injected in an amount up to about 0.4 gal per 1000 gal of water.

3. The method of claim 1 in which the water stream contains less than about 100 ppm suspended naphthalenic solids.

4. The method of claim 1 in which the water stream contains less than about 50 ppm suspended naphthalenic solids.

5. The method of claim 3 or 4 in which the solvent is injected in an amount from about 0.015 to about 0.20 gal per 1000 gal of water.

6. A method for cooling a water stream containing suspended naphthalenic solids that avoids heat exchanger blockage comprising (a) physically separating the naphthalenic solids from the water stream to afford a substantially clarified water stream containing less than about 225 ppm suspended naphthalenic solids, (b) injecting an amount of a substantially water immiscible solvent for naphthalene into the substantially clarified water stream which is effective to prevent deposition of naphthalenic solids on the cooling surfaces of a downstream indirect heat exchanger, (c) mixing the solvent and water stream to yield a dispersion of the solvent in the water stream, and (d) cooling the water stream containing the dispersed solvent in the indirect heat exchanger.

7. The method of claims 1 or 6 in which the substantially water immiscible solvent for naphthalene has a vapor pressure sufficiently high to permit the solvent to vaporize when sprayed as a dispersion in water in a gas-cooling water contacting zone.

8. The method of claim 6 in which the solvent is injected in an amount up to about 0.4 gal per 1000 gal of water.

9. The method of claim 6 in which the substantially clarified water stream from step (a) has a suspended naphthalenic solids content less than about 100 ppm.

10. The method of claim 6 in which the substantially clarified water stream from step (a) has a suspended naphthalenic solids content less than about 50 ppm.

11. The method of claims 9 or 10 in which the solvent is injected in step (b) in an amount from about 0.015 to about 0.2 gal per 1000 gal of water.

12. The method of claim 11 in which the water stream is flowing at about 2 to 3 ft/sec and is cooled about 5° to 15° C. in step (d).

13. A method for cooling a naphthalene-containing gas stream comprising (a) cooling the naphthalene-containing gas stream by contacting with water, (b) collecting the water now containing dissolved and suspended naphthalenic solids, (c) physically separating the solids from the water to afford a substantially clarified water containing less than about 225 ppm suspended naphthalenic solids, (d) injecting an amount of a substantially water immiscible solvent for naphthalene into the substantially clarified water from step (c) which amount is effective to prevent deposition of naphthalenic solids on the cooling surfaces of a downstream indirect heat exchanger, (e) mixing the solvent and water to yield a dispersion of the solvent in the substantially clarified water, (f) cooling the substantially clarified water containing the dispersed solvent in an indirect heat exchanger, and (g) recycling the cooled water to step (a).

14. The method of claim 13 in which the substantially water immiscible solvent for naphthalene has a vapor pressure sufficiently high to permit the solvent to vaporize when sprayed as a dispersion in the recycled water for gas-cooling in step (a).

15. The method of claim 13 in which the solvent is injected in an amount up to about 0.4 gal per 1000 gal of water.

16. The method of claim 13 in which the substantially clarified water from step (c) has a suspended naphthalenic solids content less than about 100 ppm.

17. The method of claim 13 in which the substantially clarified water from step (c) has a suspended naphthalenic solids content less than about 50 ppm.

18. The method of claims 16 or 17 in which the solvent is injected in step (d) in an amount from about 0.015 to about 0.20 gal per 1000 gal of water.

19. The method of claim 18 in which the water is flowing at about 2 to 3 ft/sec and is cooled about 5° to 15° C. in step (f).

20. The method of claim 15 in which the naphthalene-containing gas is coke oven gas.

* * * * *

UNITED STATES PATENT AND TRADEMARK OFFICE

CERTIFICATE OF CORRECTION

PATENT NO. : 4,234,389

DATED : November 18, 1980

INVENTOR(S) : James B. Lynn et al.

It is certified that error appears in the above—identified patent and that said Letters Patent is hereby corrected as shown below:

Column 2, line 45, "Sch.uml/o/n" should read -- Schön --.

Column 3, line 44, "cooking" should read -- cooling --.
Column 4, line 1, "as" should read -- gas --.
Column 4, line 31, "exchange" should read -- exchanger --.
Column 4, line 43, "an" should read -- and --.
Column 7, line 37, "of" should read -- or --.
Column 8, line 21, "as" should read -- gas --.

Signed and Sealed this

Tenth Day of March 1981

[SEAL]

*Attest:*

RENE D. TEGTMEYER

*Attesting Officer* *Acting Commissioner of Patents and Trademarks*